US007148616B2

(12) United States Patent
Oda et al.

(10) Patent No.: US 7,148,616 B2
(45) Date of Patent: Dec. 12, 2006

(54) COLOR PICTURE TUBE

(75) Inventors: Hiroyuki Oda, Ibaraki (JP); Tohru Takahashi, Takatsuki (JP)

(73) Assignee: Matsushita Toshiba Picture Display Co., Ltd., Osaka (JP)

( * ) Notice: Subject to any disclaimer, the term of this patent is extended or adjusted under 35 U.S.C. 154(b) by 73 days.

(21) Appl. No.: 11/092,356

(22) Filed: Mar. 29, 2005

(65) Prior Publication Data

US 2005/0225226 A1 Oct. 13, 2005

(30) Foreign Application Priority Data

Apr. 7, 2004 (JP) ..... 2004-113297

(51) Int. Cl.
*H01J 31/00* (2006.01)

(52) U.S. Cl. ..... 313/477 R; 313/461; 220/2.1 A; 220/2.1 R

(58) Field of Classification Search ..... 313/461, 313/477 R, 479; 220/2.1 A, 2.1 R
See application file for complete search history.

(56) References Cited

U.S. PATENT DOCUMENTS 4,786,840 A * 11/1988 Ragland, Jr. ..... 313/477 R
5,276,377 A * 1/1994 Van Nes et al. ..... 313/461
5,606,217 A * 2/1997 Hirai et al. ..... 313/477 R
6,157,124 A * 12/2000 Wakasono ..... 313/461
6,448,706 B1 9/2002 Kawamura et al.
6,639,347 B1 * 10/2003 Ko ..... 313/461
2003/0164669 A1 9/2003 Kim et al.

FOREIGN PATENT DOCUMENTS

| | | |
|---|---|---|
| EP | 0 438 197 | 7/1991 |
| EP | 0 899 769 | 3/1999 |
| JP | 55-28269 | 2/1980 |
| JP | 2004-14433 | 1/2004 |

* cited by examiner

*Primary Examiner*—Nimeshkumar D. Patel
*Assistant Examiner*—Anthony Perry
(74) *Attorney, Agent, or Firm*—Hamre, Schumann, Mueller & Larson P.C.

(57) ABSTRACT

A curve formed by an inner surface of a face panel in a cross-section including a tube axis of a color picture tube is defined. The face panel includes at least one cross-section in which the curve has an inflection point between a center of the face panel and a circumferential edge of an effective display region. Assuming that a maximum value of an angle formed by a tangent of the curve and a plane orthogonal to the tube axis between the center of the face panel and the inflection point is θA, and a minimum value of an angle formed by the tangent of the curve and the plane orthogonal to the tube axis between the inflection point and the circumferential edge of the effective display region is θB, the curve having the inflection point satisfies $0.6 \leqq \theta B/\theta A < 1.0$. Because of this, a color picture tube having satisfactory screen quality can be provided.

4 Claims, 3 Drawing Sheets

COLOR PICTURE TUBE

BACKGROUND OF THE INVENTION

1. Field of the Invention

The present invention relates to a color picture tube.

2. Description of the Related Art

Generally, as shown in FIG. 2, a color picture tube includes an envelope composed of a face panel 31 in a substantially rectangular shape and a funnel 32 integrally connected to the face panel 31. On an inner surface of the face panel 31, a phosphor screen 33 is formed in a substantially rectangular shape, which is composed of stripe-shaped or dot-shaped phosphor layers of three colors respectively emitting blue, green, and red light. A shadow mask 34 in a substantially rectangular shape with a number of apertures formed in a substantially rectangular region corresponding to a substantially rectangular effective display region of a screen is attached to an inner wall of the face panel 31. On the other hand, an electron gun 37 emitting three electron beams 36R, 36G, and 36B is placed in a neck 35 of the funnel 32. The three electron beams 36R, 36G, and 36B emitted from the electron gun 37 are deflected by a horizontal deflection magnetic field and a vertical deflection magnetic field generated by a deflection yoke 38 mounted on an outer side of the funnel 32. Then, the electron beams 36R, 36G, and 36B are selected by the shadow mask 34, and a part thereof passes through the apertures to scan the phosphor screen 33 in horizontal and vertical directions, thereby displaying a color image.

The inner surface shape of the face panel 31 of the color picture tube is determined considering the transmittance of glass, the outer surface shape of the face panel 31, the uniformity of brightness, the uniformity of color, visibility, the inner surface reflection of the face panel 31, deflection distortion, the curved surface of the shadow mask 34, and the like. Generally, as shown in FIG. 3, the inner surface of the face panel 31 has a concave shape in which the circumference thereof is displaced in a direction approaching the electron gun side with respect to a center $P_0$ of the inner surface of the face panel 31 through which a tube axis passes (e.g., see JP 55(1980)-28269 A).

For convenience in the following description, the displacement amount in a direction parallel to the tube axis at each position of the inner surface of the face panel 31 with respect to the center $P_0$ will be referred to as a "sinking amount". Furthermore, an axis, which is orthogonal to the tube axis in a direction parallel to a short side of the face panel 31, will be referred to a short axis, and an intersection point between a surface including the short axis and the tube axis, and a circumferential edge of the effective display region of the face panel 31 will be referred to as a short axis direction end. Furthermore, an axis, which is orthogonal to the tube axis in a direction parallel to a long side of the face panel 31, will be referred to as a long axis, and an intersection point between a surface including the long axis and the tube axis and the circumferential edge of the effective display region of the face panel 31 will be referred to as a long axis direction end. Furthermore, an intersection point between a surface including a diagonal axis of the effective display region in a rectangular shape and the tube axis, and the circumferential edge of the effective display region of the face panel 31 will be referred to as a diagonal axis direction end.

Since the effective display region of the face panel 31 has a substantially rectangular shape, the respective distances from the center $P_0$ of the inner surface of the face panel 31 to the short axis direction end, the long axis direction end, and the diagonal axis direction end are different from each other. In the case where the sinking amounts with respect to the center $P_0$ at the short axis direction end, the long axis direction end, and the diagonal axis direction end are varied in accordance with the difference in distance (i.e., in the case where the sinking amount is set to be larger with distance from the center $P_0$), each sinking amount of the inner surface of the face panel 31 along the short axis, the long axis, and the diagonal axis changes quadratically.

However, in the case where the sinking amounts with respect to the center $P_0$ at the short axis direction end, the long axis direction end, and the diagonal axis direction end are set to be the same, in particular, the sinking amount of the inner surface of the face panel 31 along the diagonal axis does not change quadratically, and a change curve of the sinking amount has an inflection point in a region 51 in the vicinity of the diagonal axis direction end farthest from the center $P_0$, as shown in FIG. 4.

Recently, in order to reduce the reflection of outside light on the inner surface of the face panel 31 to enhance contrast, tinted glass having a small transmittance with respect to visible light is used sometimes. In the face panel 31 using tinted glass (such a face panel will be referred to as a "tinted panel"), when the thickness of glass varies in the effective display region, the uniformity of brightness degrades remarkably. Thus, it is preferable to minimize the difference in sinking amount in the tinted panel. This makes it impossible to increase the sinking amount at the diagonal axis direction end farthest from the center $P_0$, and consequently, the change curve of the sinking amount is likely to have an inflection point in the tinted panel, as shown in FIG. 4.

Furthermore, at present times, there is a tendency that the outer surface of the face panel 31 is flattened. It is relatively easy to reduce the difference in thickness of glass with respect to the center $P_0$ in the effective display region in a conventional face panel having a convex curve on an outer surface, which makes it relatively easy to maintain the uniformity of brightness in the case of using tinted glass. However, in order to flatten the outer surface of the face panel 31 while keeping the thickness at each position in the effective display region to be the same as that of the face panel having a convex curve on an outer surface, it is necessary to reduce the sinking amount at the circumference with respect to the center $P_0$ of the inner surface of the face panel. Consequently, in the face panel with the outer surface flattened, the change curve of a sinking amount is likely to have an inflection point, as shown in FIG. 4.

As shown in FIG. 4, in the case where the change curve of a sinking amount of the inner surface of the face panel 31 has an inflection point, the state of a film such as the phosphor screen 33 formed on the inner surface of the face panel 31 changes, compared with the case having no inflection point. This will be described below.

Generally, in a color picture tube, as means for forming a film on the inner surface of a face panel, an exposure and development system is used. According to this system, the following usually is performed. A film material is applied to an inner surface of a face panel, which is rotated to form a thin film over the entire surface, and exposed to light using a shadow mask as an exposure mask, followed by development.

When a coating film is formed by the exposure and development system, in the case where the change curve of a sinking amount of the inner surface of a face panel does not have an inflection point, a coating film with a thickness varied gradually from the center to the circumference is obtained. On the other hand, in the case where the change curve has an inflection point, a coating film is formed in which the thickness is varied irregularly after the inflection point, and generally is small irregularly on the circumferential side with respect to the inflection point.

Such an irregular variation in thickness can be corrected by changing the setting of an exposure system, such as adjusting an exposure amount. However, there is a limit to the correction, and in some cases, a phenomenon such as overexposure occurs due to the extremely small thinness of a film, degrading the screen quality remarkably As a specific example, the case will be considered where a black matrix, which is a black non-light-emitting substance to be applied so as to mainly enhance a tube surface color in a color picture tube, is fixed. Generally, in order to fix the black matrix, the following processes are performed: coating of a resist film on the inner surface of a face panel, mask exposure via a shadow mask, development of the resist film, coating of a black matrix, and removal of a developed resist portion. In these processes, when an irregularly thin portion is present in the applied resist film, an exposure region becomes large in the thin portion, and the fixing amount of the black matrix decreases irregularly in that portion. Consequently, the size of a phosphor region (phosphor size) to be formed in a non-fixed portion of the black matrix increases.

Alternatively, in an excessively thin portion of the applied resist film, an overexposure phenomenon of a resist occurs, causing the burning of the resist. Irrespective of whether the resist is developed in that portion, it is not removed finally. Thus, the black matrix on the resist is not removed, either, and consequently the black matrix adheres to an undesired portion, which reduces a phosphor size.

Thus, the irregular variation in thickness, in particular the variation in which the thickness decreases irregularly, degrades screen quality, and further, causes a remarkable degradation in image quality.

SUMMARY OF THE INVENTION

The present invention solves the above-mentioned problems of the conventional color picture tube, and its object is to provide a color picture tube having satisfactory screen quality in which, even in the case where a change curve of a sinking amount of the inner surface of a face panel has an inflection point, defects of a film to be formed on the inner surface of the face panel are reduced.

A color picture tube of the present invention includes: a face panel; a phosphor screen provided on an inner surface of the face panel; an electron gun opposed to the phosphor screen and emitting an electron beam incident upon the phosphor screen; and a shadow mask placed between the phosphor screen and the electron gun and having a plurality of apertures for selecting the electron beam in a substantially rectangular region corresponding to an effective display region of a screen.

When a curve formed by the inner surface of the face panel in a cross-section including a tube axis of the color picture tube is defined, the face panel includes at least one cross-section in which the curve has an inflection point between a center of the face panel and a circumferential edge of the effective display region. Assuming that a maximum value of an angle formed by a tangent of the curve and a plane orthogonal to the tube axis between the center of the face panel and the inflection point is $\theta A$, and a minimum value of an angle formed by the tangent of the curve and the plane orthogonal to the tube axis between the inflection point and the circumferential edge of the effective display region is $\theta B$, the curve having the inflection point satisfies $0.6 \leqq \theta B/\theta A < 1.0$.

These and other advantages of the present invention will become apparent to those skilled in the art upon reading and understanding the following detailed description with reference to the accompanying figures.

DESCRIPTION OF THE PREFERRED EMBODIMENTS

According to the present invention, a color picture tube can be provided, which has satisfactory display image quality due to satisfactory screen quality.

In the above-mentioned color picture tube of the present invention, it is preferable that an outer surface of the face panel is substantially flat. More specifically, it is preferable that a radius of curvature of the outer surface is 10,000 mm or more. This can enhance the visibility of a display screen. Furthermore, according to the present invention, even if the face panel has such a flat outer surface, a phosphor screen of high quality can be formed on the inner surface thereof.

Furthermore, it is preferable that the face panel is made of tinted glass. This can prevent a decrease in contrast caused when external light is reflected from the inner surface of the face panel to be recognized visually, so that the visibility of a display screen can be enhanced. Furthermore, according to the present invention, even in the case of a face panel made of tinted glass and having a small variation in thickness so as to ensure the uniformity of brightness, a phosphor screen of high quality can be formed on the inner surface thereof. In the present invention, the "tinted glass" refers to glass having a light transmittance of 60% or less at a thickness of 10.16 mm.

Furthermore, it is preferable that $0.8 \leqq \theta B/\theta A < 1.0$ is satisfied. This enables further satisfactory screen quality to be obtained.

Hereinafter, a color picture tube of the present invention will be described with reference to the drawings.

Figure 2:
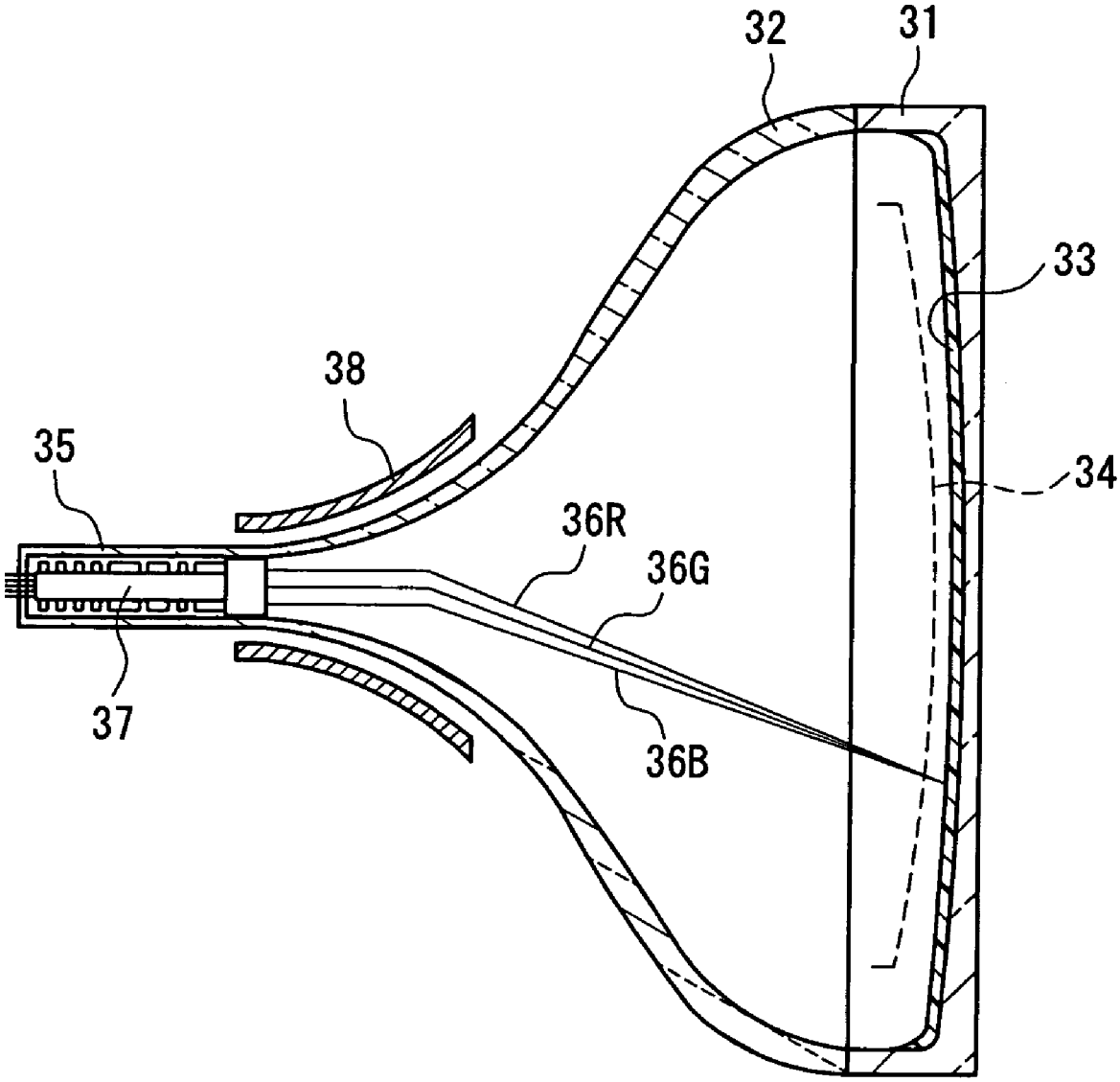
FIG. 2 PRIOR ART
FIG. 2 is a cross-sectional view showing an entire configuration of an example of a color picture tube.
Figure 3:
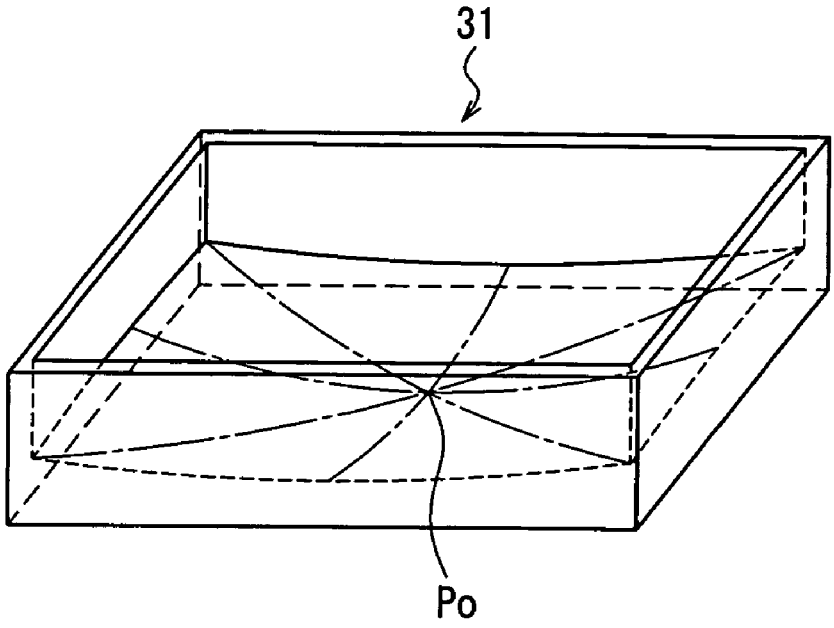
FIG. 3 PRIOR ART
FIG. 3 is a perspective view showing an example of an inner surface shape of a face panel of a conventional color picture tube.
Figure 4:
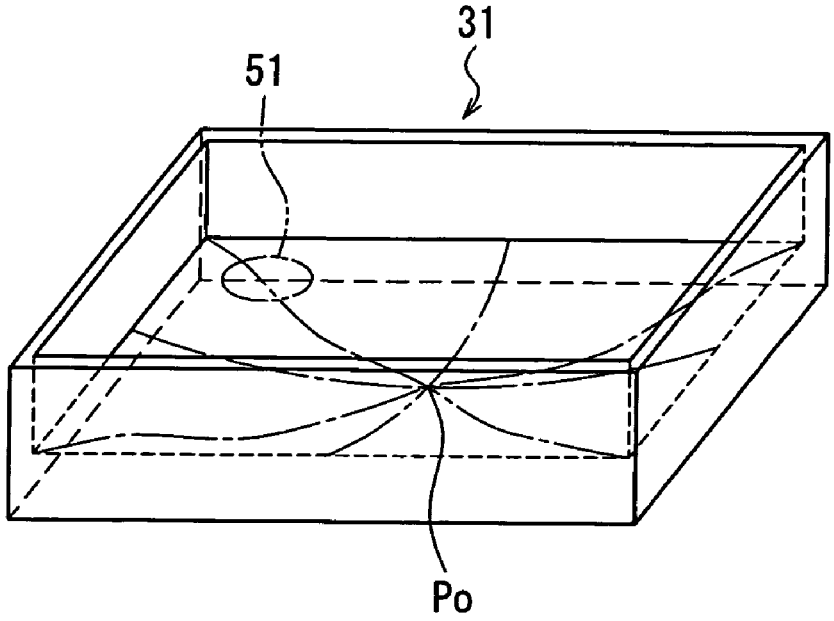
FIG. 4 PRIOR ART
FIG. 4 is a perspective view showing an example of an inner surface shape of a conventional face panel in which sinking amounts at a short axis direction end, a long axis direction end, and a diagonal axis direction end of the inner surface are the same.

The color picture tube of the present invention is not particularly limited except for an inner surface shape of a face panel, and for example, may be the same as that of the conventional color picture tube shown in FIG. 2. Thus, the redundant description will be omitted here.

Figure 1A:
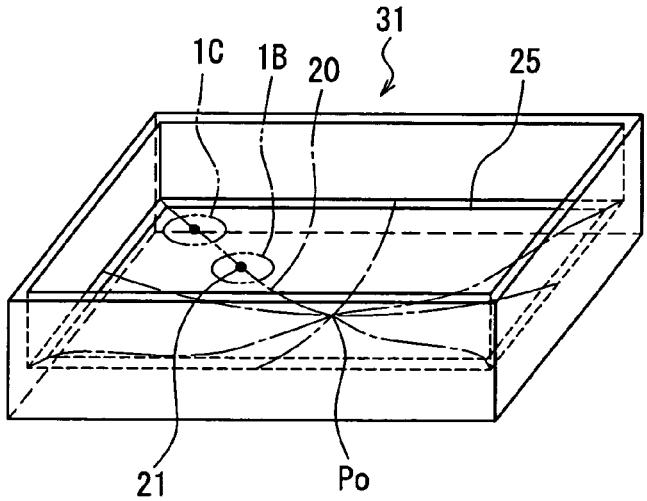
FIG. 1A is a perspective view showing one embodiment of an inner surface shape of a face panel of a color picture tube of the present invention.

FIG. 1A is a perspective view of one embodiment of a face panel 31 of a color picture tube according to the present invention. In FIG. 1A, $P_0$ denotes an intersection point between the inner surface of the face panel 31 and a tube axis of the color picture tube, which corresponds to the center of the face panel 31.

Herein, a curve 20 formed by the inner surface of the face panel 31 in a cross-section of the face panel 31 on a plane including a diagonal axis of an effective display region 25 in a substantially rectangular shape and the tube axis of the color picture tube (hereinafter, referred to as a "diagonal axis direction cross-section") will be paid attention to. In the face panel 31 of the present embodiment, the curve 20 in the diagonal axis direction cross-section has an inflection point 21 between the center $P_0$ and a diagonal axis direction end. That is, in the diagonal axis direction cross-section, a tangent of the curve 20 at a point on the curve 20 is positioned on an opposite side of an electron gun with respect to the curve 20 in a range between the center $P_0$ and the inflection point 21, and is positioned on an electron gun side with respect to the curve 20 in a range between the inflection point 21 and the diagonal axis direction end.

Figure 1B:
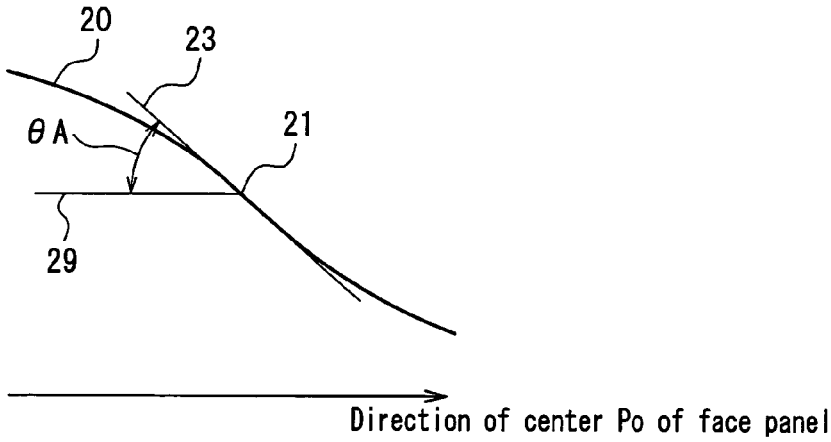
FIG. 1B shows a curve formed by the inner surface of the face panel in a diagonal axis direction cross-section of a portion 1B in the vicinity of an inflection point in FIG. 1A.
Figure 1C:
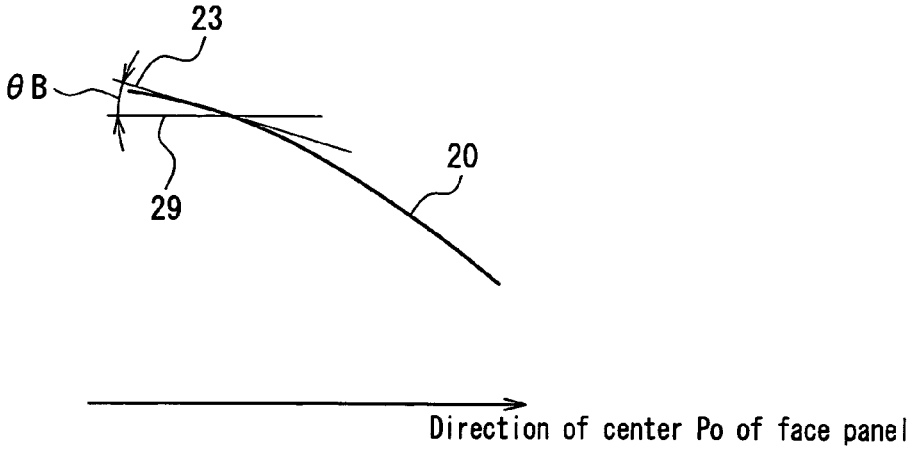
FIG. 1C shows a curve formed by the inner surface of the face panel in the diagonal axis direction cross-section of a portion 1C on the side of a diagonal axis direction end with respect to the inflection point in FIG. 1A.

Furthermore, as shown in FIG. 1B showing a diagonal axis direction cross-section in a portion 1B in the vicinity of the inflection point 21 in FIG. 1A, it is assumed that a maximum value of an angle formed by a tangent 23 at a point on the curve 20 between the center $P_0$ and the inflection point 21, and a plane 29 orthogonal to the tube axis is θA (θA<90°). In the present embodiment, the maximum value θA is obtained at the inflection point 21. Furthermore, as shown in FIG. 1C showing a diagonal axis direction cross-section in a portion 1C on the side of the diagonal axis direction end with respect to the inflection point 21 in FIG. 1A, a minimum value of an angle formed by the tangent 23 at a point on the curve 20 between the inflection point 21 and the diagonal axis direction end, and the plane 29 orthogonal to the tube axis is θB (θB<90°). In the present embodiment, the minimum value θB is obtained at the diagonal axis direction end. In the present embodiment, $0.6 \leqq \theta B/\theta A < 1.0$ is satisfied. More preferably, $0.8 \leqq \theta B/\theta A < 1.0$ is satisfied. In FIGS. 1B and 1C, a vertical axis representing the sinking amount of the inner surface of the face panel is exaggerated for purposes of illustration.

In the present embodiment, since the inner surface of the face panel 31 has the above-mentioned shape, even when the curve 20 has the inflection point 21, an irregular variation in thickness caused by the inflection point 21 is prevented from occurring in a coating film formed by coating on the inner surface. Consequently, satisfactory screen quality can be obtained.

This will be described using Table 1. Table 1 shows a summary of the evaluation of each obtained phosphor screen, when the phosphor screen is formed on the inner surface of the face panel 31 by variously changing θB/θA.

TABLE 1

| | Phosphor size | | |
|---|---|---|---|
| θB/θA | Variation | Size | Screen quality |
| 1.00 | Small | Medium | Excellent |
| 0.95 | Small | Medium | Excellent |
| 0.90 | Small | Medium | Excellent |
| 0.85 | Small | Medium | Excellent |
| 0.80 | Small | Medium | Excellent |
| 0.75 | Small | Large | Satisfactory |
| 0.70 | Small | Large | Satisfactory |

TABLE 1-continued

| | Phosphor size | | |
|---|---|---|---|
| θB/θA | Variation | Size | Screen quality |
| 0.65 | Small | Large | Satisfactory |
| 0.60 | Small | Large | Satisfactory |
| 0.55 | Large | Small | Unsatisfactory |
| 0.50 | Large | Small | Unsatisfactory |
| 0.45 | Large | Small | Unsatisfactory |
| 0.40 | Large | Small | Unsatisfactory |

As is understood from Table 1, in the case where θB/θA is less than 0.6, the variation in phosphor size becomes large, and the phosphor size becomes small. The reason for this is as follows. As described in the related art section, in this case, the thickness of a resist film becomes small in a region on the side of the diagonal axis direction end with respect to the inflection point 21, and burning of a resist is likely to occur. Consequently, the size of a black matrix is varied largely between a portion where burning of the resist occurs and a portion where burning of the resist does not occur, whereby the variation in phosphor size becomes large. Furthermore, in the portion where burning occurs, the resist and the black matrix thereon cannot be removed, so that the phosphor size becomes very small. Thus, in this case, it is difficult to obtain satisfactory screen quality.

In contrast, in the case where θB/θA is equal to or more than 0.6 and less than 0.8, although the phosphor size tends to become large, the variation thereof becomes small. The reason for this is as follows. Even in this case, the thickness of a resist film becomes small in a region on the side of the diagonal axis direction end with respect to the inflection point 21. However, the resist film is not so thin as to be burnt by overexposure, and a resist exposure region is rather enlarged, whereby a black matrix region becomes small. Consequently, although the phosphor size tends to become large, the variation in phosphor size becomes relatively small. The enlargement of the phosphor size to such a degree can be corrected by adjusting an exposure system. Thus, in this case, satisfactory screen quality can be obtained.

Furthermore, in the case where θB/θA is equal to or more than 0.8 and less than 1.0, even if the exposure system is not adjusted, a desired phosphor size is obtained, which is almost equal to that of the case where the curve 20 does not have an inflection point, and the variation in phosphor size also is very small. Thus, in this case, very satisfactory screen quality can be obtained, which is substantially equal to that in the case where the curve 20 does not have an inflection point.

As described above, if θB/θA is equal to or more than 0.6 and less than 0.8, satisfactory screen quality can be obtained. Furthermore, if θB/θA is equal to or more than 0.8 and less than 1.0, very excellent screen quality can be obtained.

In the above embodiment, the case where the curve 20 formed by the inner surface of the face panel 31 in the diagonal axis direction cross-section has the inflection point 21 has been described. However, the present invention is not limited thereto. In at least one cross-section among the cross-sections including the tube axis of the color picture tube (i.e., a cross-section including the tube axis and the short axis, a cross-section including the tube axis and the long axis, or at least one cross-section among the cross-sections including the tube axis other than those described above), the curve formed by the inner surface of the face panel 31 only needs to have an inflection point. In the case where the curve has an inflection point, θB/θA defined with respect to the curve should be in the above-mentioned particular numerical value range. This enables satisfactory screen quality similar to that of the above embodiment to be obtained.

EXAMPLES

The present invention will be described further by way of specific examples.

Example 1

Comparative Example 1

As Example 1, the case where the present invention was applied to a color picture tube with a diagonal size of 68 cm will be described. The face panel 31 of the color picture tube was made of tinted glass, and the outer surface thereof was set to be substantially flat.

Furthermore, as described in the related art section, the inner surface shape of the face panel 31 was designed so that the difference in thickness of glass with respect to the center $P_0$ was small even at the diagonal axis direction end. Consequently, in the diagonal axis direction cross-section, the curve 20 formed by the inner surface of the face panel 31 had the inflection point 21 between the center $P_0$ and the diagonal axis direction end. Furthermore, the maximum value θA of an angle formed by the tangent at a point on the curve 20 between the center $P_0$ and the inflection point 21, and the plane orthogonal to the tube axis was 4.00°, and the minimum value θB of an angle formed by the tangent at a point on the curve 20 between the inflection point 21 and the diagonal axis direction end, and the plane orthogonal to the tube axis was 2.86°. Thus, θB/θA was 0.71. Among various cross-sections including the tube axis, the cross-section in which the curve formed by the inner surface of the face panel 31 had an inflection point also was present in the cross-sections other than the diagonal axis direction cross-section, and the curve in any cross-section satisfied $0.6 \leqq \theta B/\theta A < 1.0$. The value of θB/θA was minimum in the curve 20 in the diagonal axis direction cross-section among these various curves.

A phosphor screen was formed on the inner surface with such a shape. Consequently, burning of a resist film did not occur, and a phosphor with a desired size was obtained by optimizing an exposure system. Thus, satisfactory screen quality was obtained.

In contrast, as Comparative Example 1, the same face panel as that of Example 1 was produced except for the shape of the inner surface, and a phosphor screen was formed on the inner surface in the same way as in Example 1. In Comparative Example 1, although the curve formed by the inner surface of the face panel in the diagonal axis direction cross-section had an inflection point between the center $P_0$ and the diagonal axis direction end, θA=4.04°, θB=2.04°, and θB/θA=0.50 with respect to this curve.

In Comparative Example 1, due to the burning of a resist, the phosphor size was varied and a phosphor was reduced to about 70 to 90% compared with a desired size in a partial region. Thus, in Comparative Example 1, it was difficult to obtain satisfactory screen quality.

Example 2

As Example 2, the case where the present invention was applied to a color picture tube with a diagonal size of 76 cm will be described. In the same way as in Example 1, the face panel 31 of the color picture tube also was made of tinted glass, and the outer surface thereof was set to be substantially flat.

Furthermore, the inner surface shape of the face panel 31 was designed so that the difference in thickness of glass with respect to the center $P_0$ at the diagonal axis direction end became small. Consequently, in the diagonal axis direction cross-section, the curve 20 formed by the inner surface of the face panel 31 had the inflection point 21 between the center $P_0$ and the diagonal axis direction end. Furthermore, the maximum value θA of an angle formed by the tangent at a point on the curve 20 between the center $P_0$ and the inflection point 21, and the plane orthogonal to the tube axis was 3.33°, and the minimum value θB of an angle formed by the tangent at a point on the curve 20 between the inflection point 21 and the diagonal axis direction end, and the plane orthogonal to the tube axis was 3.17°. Thus, θB/θA was 0.95. Among various cross-sections including the tube axis, the cross-section in which the curve formed by the inner surface of the face panel 31 had an inflection point also was present in cross-sections other than the diagonal axis direction cross-section, and the curve in any cross-section satisfied $0.6 \leqq \theta B/\theta A < 1.0$. The value of θB/θA was minimum in the curve 20 in the above-mentioned diagonal axis direction cross-section among these various curves.

A phosphor screen was formed on the inner surface with such a shape. Consequently, burning of a resist film did not occur, and a phosphor with a desired size was obtained without adjusting an exposure system. Thus, very excellent screen quality was obtained.

The applicable field of the present invention is not particularly limited, and the present invention can be utilized in a color picture tube used for various kinds of purposes. However, the color picture tube of the present invention has satisfactory screen quality even in the case where the outer surface of the face panel is flat, in the case where the face panel is made of tinted glass, and the like. Therefore, the present invention is highly useful in a color picture tube used in a television, a computer display, or the like requiring high display quality.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A color picture tube, comprising: a face panel; a phosphor screen provided on an inner surface of the face panel; an electron gun opposed to the phosphor screen and emitting an electron beam incident upon the phosphor screen; and a shadow mask placed between the phosphor screen and the electron gun and having a plurality of apertures for selecting the electron beam in a substantially rectangular region corresponding to an effective display region of a screen, wherein, when a curve formed by the inner surface of the face panel in a cross-section including a tube axis of the color picture tube is defined, the face panel includes at least one cross-section in which the curve has an inflection point between a center of the face panel and a circumferential edge of the effective display region, and assuming that a maximum value of an angle formed by a tangent of the curve and a plane orthogonal to the tube axis between the center of the face panel and the inflection point is θA, and a minimum value of an angle formed by the tangent of the curve and the plane orthogonal to the tube axis between the inflection point and the circumferential edge of the effective display region is θB, the curve having the inflection point satisfies $0.6 \leqq \theta B/\theta A < 1.0$.

2. The color picture tube according to claim 1, wherein an outer surface of the face panel is substantially flat.

3. The color picture tube according to claim 1, wherein the face panel is made of tinted glass.

4. The color picture tube according to claim 1, wherein $0.8 \leqq \theta B/\theta A < 1.0$ is satisfied.

* * * * *